United States Patent [19]

Westfall et al.

[11] Patent Number: 4,799,333

[45] Date of Patent: Jan. 24, 1989

[54] LOCK SHOE SYSTEM FOR TAKE-OUT WINDOW

[75] Inventors: Norman R. Westfall; James A. Martini; John I. Habbersett, all of Rochester, N.Y.

[73] Assignee: Caldwell Manufacturing Company, Rochester, N.Y.

[21] Appl. No.: 99,894

[22] Filed: Sep. 22, 1987

[51] Int. Cl.[4] ..... E05D 15/22

[52] U.S. Cl. ..... 49/446; 49/176; 49/453

[58] Field of Search ..... 49/181, 176, 161, 183, 49/446, 453, 454

[56] References Cited

U.S. PATENT DOCUMENTS

| | | | |
|---|---|---|---|
| 2,796,630 | 6/1957 | Haas | 49/181 X |
| 2,987,758 | 6/1961 | Osten, Sr. | 49/181 X |
| 3,197,819 | 8/1965 | Trout | 49/181 X |
| 3,233,278 | 2/1966 | Lundgren . | |
| 3,464,157 | 9/1969 | Rodriguez | 49/181 X |
| 3,524,282 | 8/1970 | Kraft et al. . | |
| 3,611,636 | 10/1971 | Trout . | |
| 3,789,549 | 2/1974 | Yip . | |
| 3,797,168 | 3/1974 | Trout . | |
| 3,844,066 | 10/1974 | Nobes . | |
| 4,079,549 | 3/1978 | Wood . | |
| 4,227,345 | 10/1980 | Durham, Jr. . | |
| 4,271,631 | 6/1981 | Trout . | |
| 4,364,199 | 12/1982 | Johnson et al. . | |
| 4,452,012 | 6/1984 | Deal . | |
| 4,590,708 | 5/1986 | Campodonico . | |
| 4,610,108 | 9/1986 | Marshik . | |

*Primary Examiner*—Philip C. Kannan

*Attorney, Agent, or Firm*—Stonebraker, Shepard & Stephens

[57] ABSTRACT

A lock shoe system for a take-out window having take-out jamb liners (10) uses a pair of fins (22) extending laterally outward from opposite sides (18) of a sash pin slot (16) in the jamb liner for supporting lock shoes (30) that move vertically in lock shoe channels (13 and 14) within the jamb liners. The lock shoes bear against and ride on sash sides (24) of the fins, and the lock shoes have pivotally mounted biter knives (40) that can pivot into biting engagement with a frame side (26) of the fins to lock the shoes vertically in place. Arms (45) of the biter knives are engaged by pins (25) extending from the sash (20) into the slots for holding the knives clear of the fins whenever the sash is in its run. When the sash is removed from jamb liners (10), springs (50) on the lock shoes (30) bias the biter knives (40) into locking position against the force of the counterbalance springs (33), which bias the lock shoes upward.

38 Claims, 5 Drawing Sheets

LOCK SHOE SYSTEM FOR TAKE-OUT WINDOW

BACKGROUND

The balance systems for take-out sash that can be tilted and removed from between take-out jamb liners have used shoes that ride in vertical channels within the jamb liners and lock in place when the sash is tilted inward. The shoes are biased upward by counterbalance springs, and locking the shoes in place when the sash tilts inward prevents the shoes from snapping upward, under the force of the counterbalance springs, when the sash is taken out. Tilt shoes, and the locking of tilt shoes in place in take-out jamb liners, have long been troublesome, though.

One way of locking tilt shoes in place is by a cam that enlarges a dimension of the shoe when the sash tilts so that the enlarged shoe locks within the channel in which the shoe rides. Examples of this include U.S. Pat. Nos. 3,789,549; 3,797,168; 3,844,066; 4,079,549; 4,227,345; 4,364,199; and 4,590,708. Such gripper mechanisms have proved unreliable against the slippery resin surfaces of the jamb liners. Cams in tilt shoes have also operated biter knives for biting into the jamb liner to lock the shoe against the spring force. Examples of this include U.S. Pat. Nos. 3,233,278; 3,524,282; 3,611,636; 4,271,631; 4,452,012; and 4,610,108. Such biter devices have marred the jamb liner surfaces so that movement of the shoes becomes bumpy and noisy.

We have devised an improved shoe for take-out sash running between take-out jamb liners. Our shoe locks in place with a biter knife, but the knife bites into a jamb liner surface that the shoe does not ride on so that shoe movement is not roughened by biter marks. Our shoe also locks in place when the sash is removed, rather than when the sash is tilted. This is both convenient and adequate, since the shoes do not spring upward until the weight of the sash is removed from them. Our shoe includes friction pads that can be adjusted with a screwdriver to vary the friction of the shoe within the jamb liner to compensate for hop and drop. Generally, our lock shoe system is inexpensive, reliable, durable, and easy and convenient to operate.

SUMMARY OF THE INVENTION

Our lock shoe system applies to a take-out window having take-out jamb liners with sash runs and vertically extending lock shoe channels within which a lock shoe moves vertically of the jamb liner. The jamb liners include sash pin slots, side walls of which extend laterally to form a pair of vertical fins within each of the lock shoe channels. Each of the lock shoes has bearing surfaces that engage and ride on sash side surfaces of the fins, and each of the lock shoes has a pivotally mounted biter knife disposed to bite into frame side surfaces of the fins opposite the sash side surfaces of the fins. Springs on the lock shoes bias the biter knives into biting position, and sash pins extending from the sash through the slots into engagement with the biter knives hold the biter knives out of biting position until removal of the sash from the jamb liners removes the pins from the lock shoes. Then the springs pivot the biter knives to bit into frame side surfaces of the fins and lock the shoes in place until the sash is replaced and its pins reengage the biter knives.

The lock shoes also preferably include ramp locks that are pivotally mounted to allow the sash pins to move down over the ramp locks, pivoting these aside as the pins move into engagement with the biter knives, whereupon the ramp locks snap into lock position, holding the pins in engagement with the biter knives. Preferably a single spring, mounted on each lock shoe, biases both the biter knife and the ramp lock. The lock shoes also preferably include friction pads engaging side surfaces of the pin slots and a screw arranged to adjust the frictional force of the pads against the slot surfaces to compensate for hop and drop.

DRAWINGS

DETAILED DESCRIPTION

Figure 1:
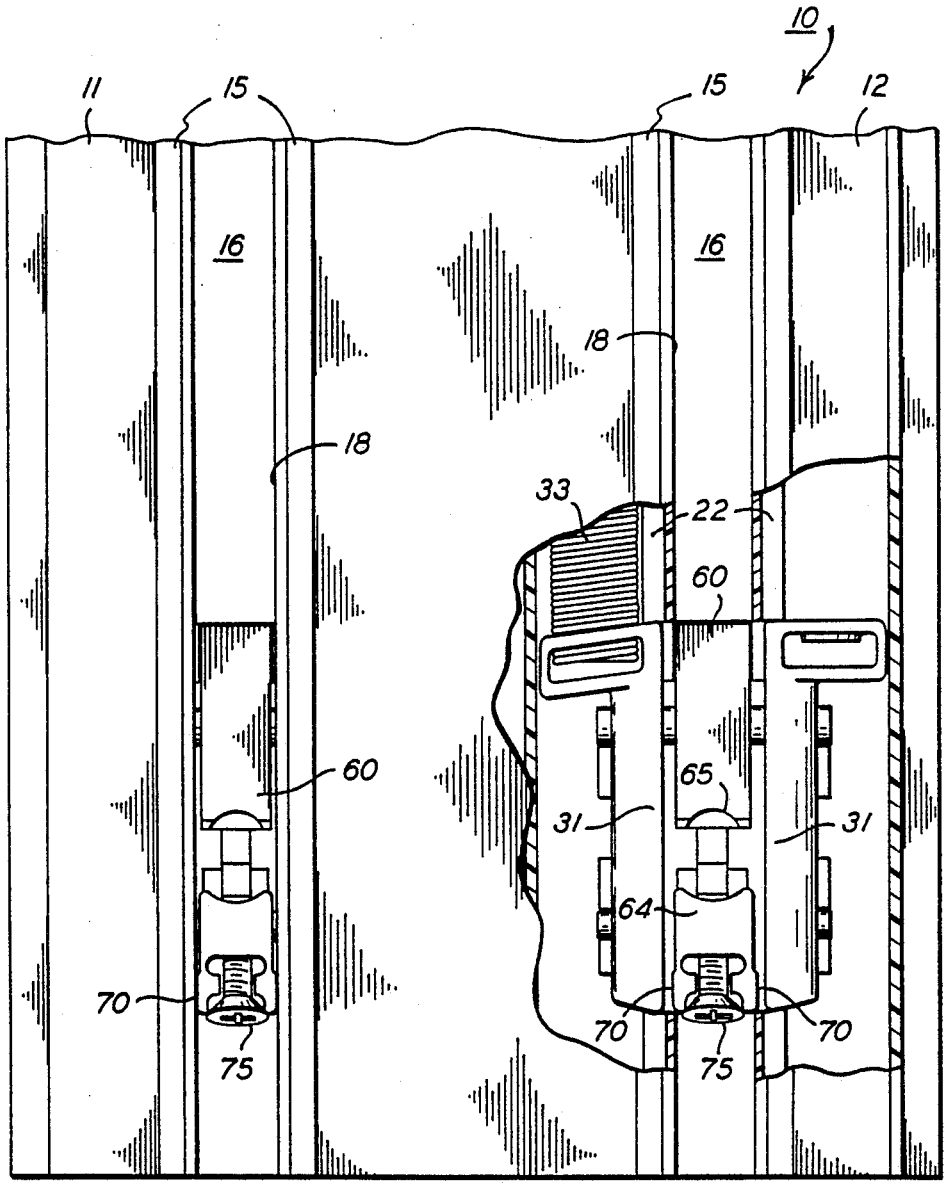
FIG. 1 is a partially cutaway, fragmentary elevational view of a take-out jamb liner having a preferred embodiment of our lock shoe system.
Figure 2:
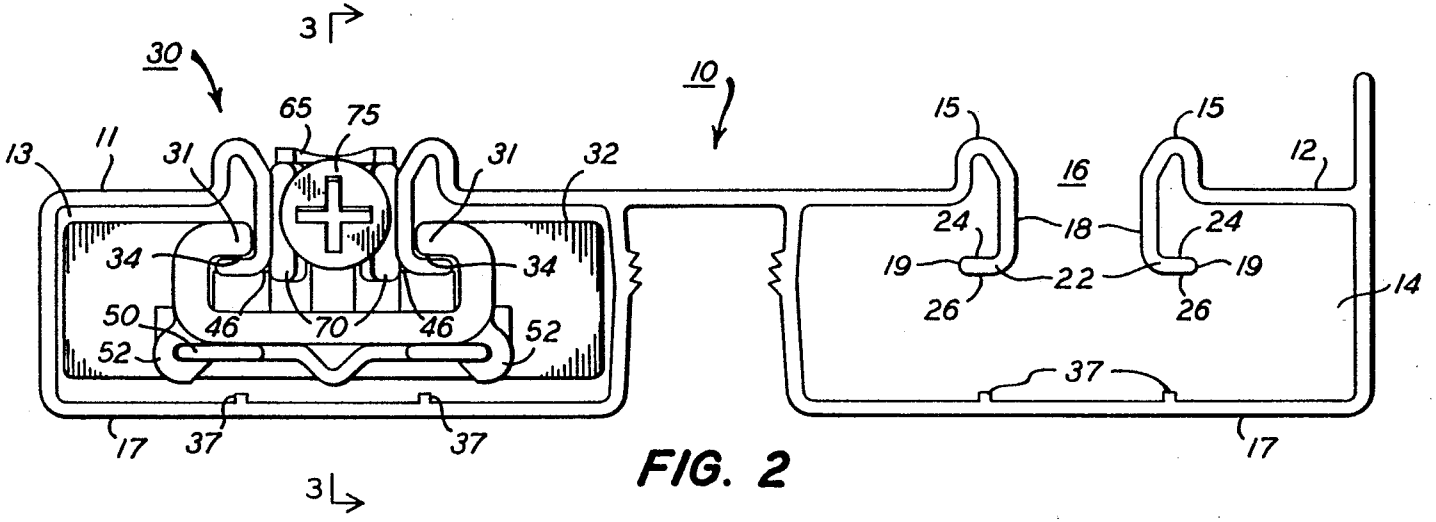
FIG. 2 is a bottom end view of the jamb liner of FIG. 1, with the right side lock shoe removed.
Figure 3:
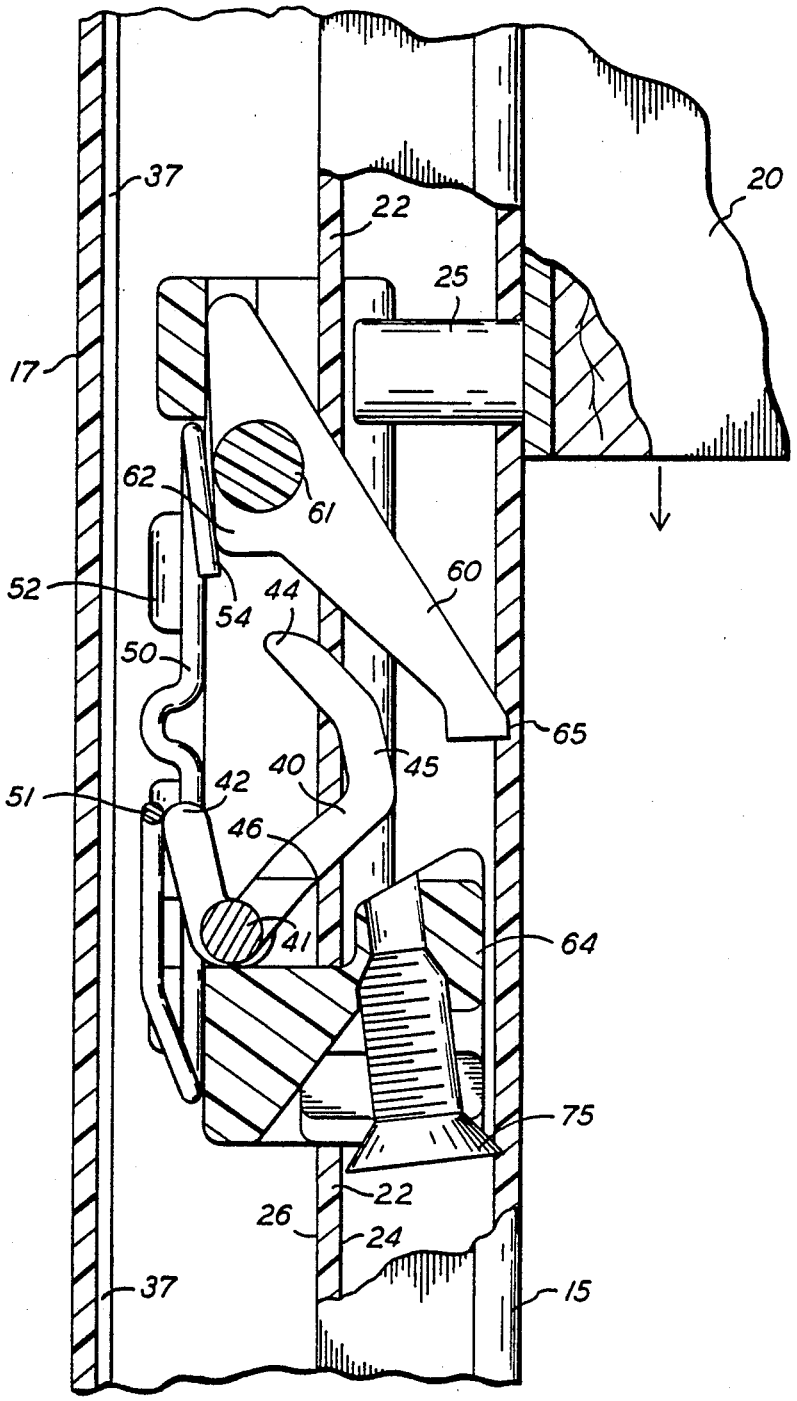
FIGS. 3-5 are cross-sectional views of the lock shoe of FIG. 2, taken along the line 3-3 thereof and partially cutting away the jamb liner, to show respectively a locked position, an unlocked position with a sash pin reentering the lock shoe, and an unlocked position with a sash pin latched into the lock shoe.
Figure 4:
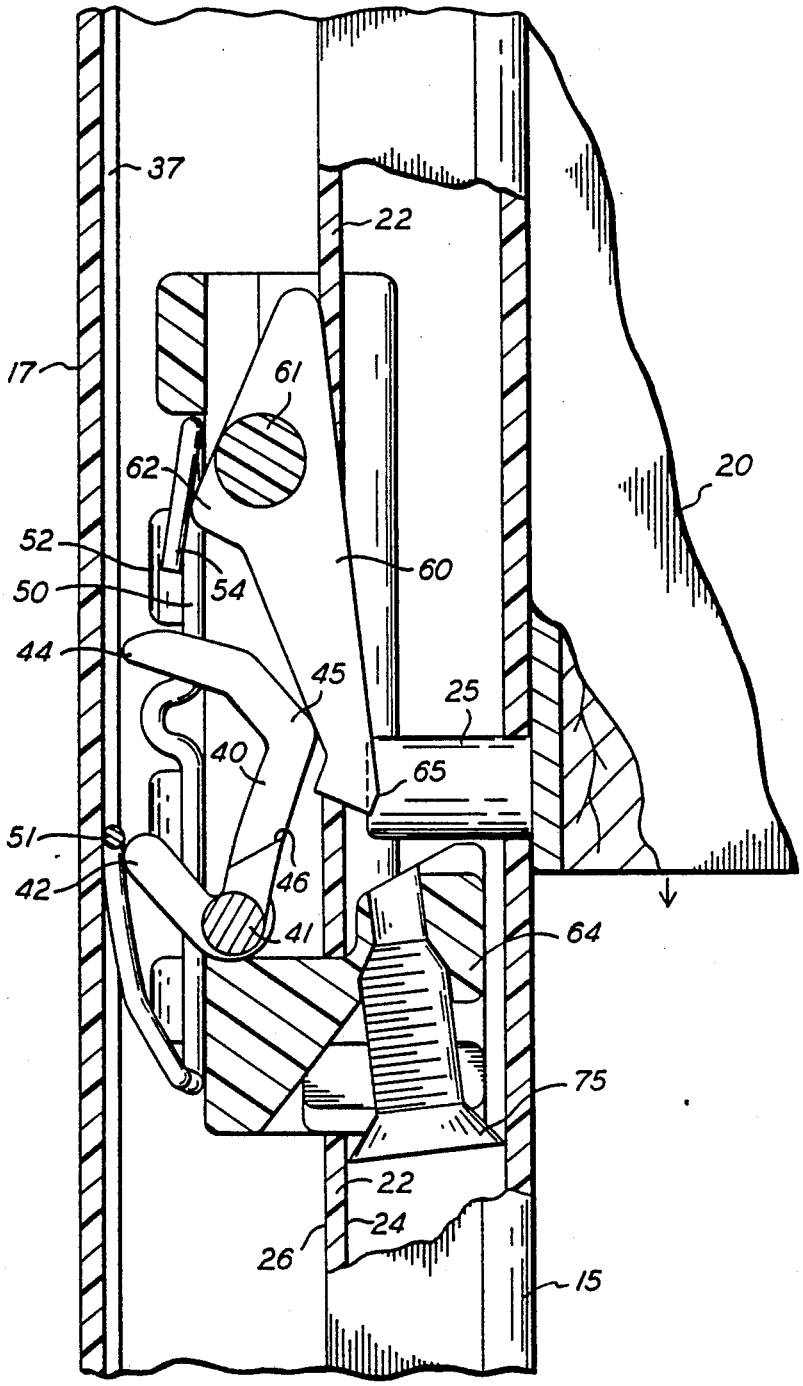
Figure 5:
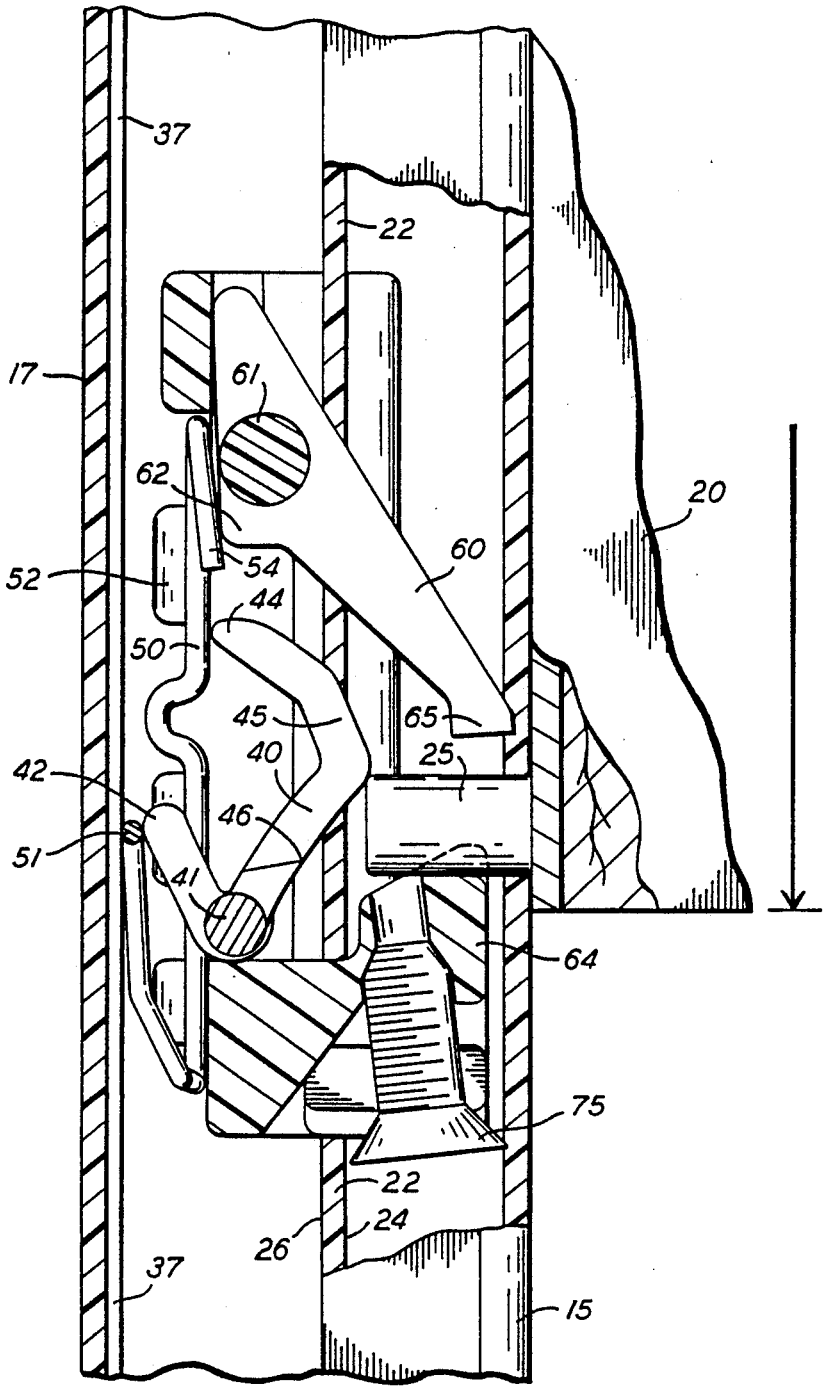

Take-out jamb liner 10, as shown in FIGS. 1 and 2, has a pair of sash runs 11 and 12 on a frame side of which are respective lock shoe channels 13 and 14. Ridges 15, on opposite sides of sash pin slots 16, guide sashes 20 in the sash runs, and sash pins 25 extend into slots 16, as shown in FIGS. 3-5. A generally flat backside 17 of jamb liner 10 fits against a window frame and disposes sash runs 11 and 12 to confront the stiles of respective sashes 20.

The side walls 18 of slots 16 extend vertically of jamb liner 10 and also extend into lock shoe channels 13 and 14 where the free ends 19 of side walls 18 extend laterally outward. The lateral extensions of side walls 18 form fins 22, which have sash side surfaces 24, facing toward sash runs 11 and 12, and have frame side surfaces 26, facing away from sash runs 11 and 12 and toward the frame side 17 of jamb liner 10.

Figure 6:
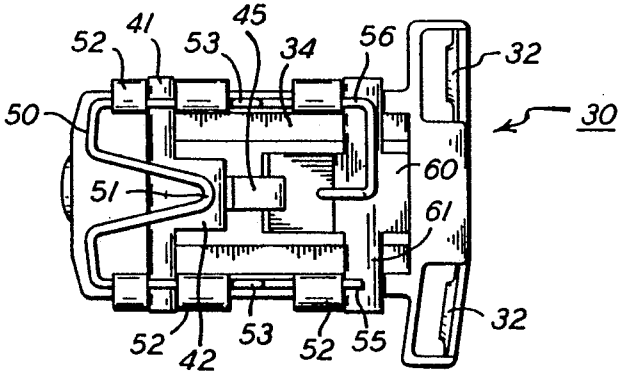
FIG. 6 is a bottom view of the lock shoe of FIGS. 1-4.

Lock shoes 30, which run vertically in channels 13 and 14, ride on fins 22. Inturned edges 31 of lock shoes 30 have bearing surfaces 34 that engage sash side surfaces 24 of fins 22 so that lock shoes 30 ride just clear of ribs 37 on the backs of channels 13 and 14. Edges 31 and bearing surfaces 34 preferably extend for the full length of lock shoes 30, as shown in FIGS. 1 and 6.

A biter knife 40, pivotally mounted on lock shoe 30, has a pair of knife edges 46 that can bite into frame side surfaces 26 of fins 22, as shown in FIGS. 2 and 3. Biter knife 40 has a pivot shaft 41 that is pivotally trapped in place on lock shoe 30 and allows biter knife 40 to pivot between the locking position shown in FIGS. 2 and 3, where knife edges 46 bite into fin surfaces 26, and the unlocked position of FIGS. 4 and 5, where sash pin 25 holds biter knife 40 clear of fins 22. Biter knife 40 also has an arm 45 engaged by sash pin 25, as shown in FIG. 5, and a lever arm 42 engaged by a loop 51 of a spring 50. Spring 50 is trapped under side projections 52 spaced along the bottom edges of lock shoe 30, where a short reach 53 of spring 50 traps pivot shaft 41 of biter knife 40.

Also mounted on lock shoe 30 is a ramp lock 60 having a pivot shaft 61 and a lever arm 62 biased by an end 54 of spring 50 to the latched position shown in FIGS. 3 and 5. Another end 55 and a reach 56 of spring 50 trap pivot shaft 61 of ramp lock 60 rotatably in place on shoe 30. A free end 65 of ramp lock 60 is preferably rounded, as shown in FIGS. 1 and 2, to fit around sash pin 25. As sash 20 moves downward onto a locked shoe 30, as shown in FIGS. 3-5, it rides along ramp lock 60, pivoting ramp lock 60 from the position of FIG. 3 to the position of FIG. 4, whereupon sash pin 25 slides over the free end 65 of ramp lock 60 and locks into shoe 30 in a position engaging arm 45 of biter knife 40 to hold knife edges 46 clear of fin surfaces 26. In this position, sash pin 25 is locked between abutment 64, which is also preferably rounded to receive sash pin 25, and the rounded end 65 of ramp lock 60. While sash pins 25 slide downward over ramp lock 60, in the position shown in FIG. 4, ramp lock 60 overlaps and depresses a nose 44 of biter knife 40, to unlock shoe 30, which is now bearing the weight of sash 20.

Another feature of lock shoe 30 is a pair of friction pads 70 that engage side surfaces 18 of slot 16 and can be variably spread apart by adjustment screw 75. As screw 75 is turned deeper in between friction pads 70, its head spreads pads 70 farther apart and presses them more tightly against slot side walls 18. This increases the friction of moving shoe 30 up and down in a shoe channel 13 or 14. Such friction can compensate for hop and drop of a sash 20, and screw 75 is conveniently available for adjustment by a screw driver inserted into a slot 16 near the bottom corner of sash 20.

In operation, with sash 20 positioned in a sash run, sash pins 25 extend into slots 16 where they engage arms 45 of biter knives 40, holding knife edges 46 clear of the frame side surfaces 26 of fins 22. This frees shoes 30 to move vertically within shoe channels 13 or 14 in jamb liners 10. At least one of the spring connectors 32 at the upper end of lock shoes 30 are connected to a spring 33 that biases shoes 30 upward to counterbalance sash 20. If the weight of sash 20 and the force of balance springs 33 produces hop or drop, screws 75 can be respectively tightened or loosened to compensate. Sash 20 then runs smoothly up and down one of the sash runs 11 or 12; and as this occurs, bearing surfaces 34 on shoes 30 ride against the sash side surfaces 24 of fins 22.

Sash 20 can be tilted inward, because pins 25 are rotatable within shoes 30, and ridges 15 are flexible enough to accommodate such tilting motion. This can be done for washing the glass in sash 20 without removing sash 20 from in between jamb liners 10. Such tilting movement does not remove pins 25 from shoes 30 and does not lock biter knives 40 in place.

Sash 20 can also be removed from between jamb liners 10, and this is done by side tilting a sash that has been tilted inward so that shoes 30 move to different heights on opposite sides of the sash. This removes pins 25 from shoes 30, so that spring loops 51, engaging lever arms 42, pivot biter knives 40 into locking positions in which knife edges 46 bite into frame side surfaces 26 of fins 22. This does not mar bearing surfaces 24 on the opposite sides of fins 22, against which surfaces 34 of shoes 30 continue to ride smoothly. With knives 40 in biting position, shoes 30 are locked in channels 13 and 14 against the upward force of balance springs 33. Once removed, sash 20 could have its glass replaced, for example.

To replace sash 20 in between jamb liners 10 only requires tilting the sash so that its pins 25 enter slots 16 above the positions where shoes 30 are locked in place. Then sash 20 can be lowered to bring its pins 25 down onto ramp locks 60, to pivot them aside as shown in FIG. 4. As ramp locks 60 pivot against biter knives 40, they unlock knife edges 46, as shown in FIG. 4, as the weight of the sash transfers to shoes 30 and counterbalance springs 33. When pins 25 slide down to the locked position shown in FIG. 5, ramp locks 60 snap into their locked positions, retaining pins 25 against abutments 64. In this position, pins 25 also hold biter knives 40 clear of fins 22. Sash 20 can then be tilted back into alignment with its sash run.

Operation of biter knives 40 only when sash 20 is removed from between jamb liners 10 minimizes the biting action of knives 40 and uses this only when necessary because of removal of the sash weight from shoes 30. The biting process, no matter how many times employed, does not interfere with smooth vertical movement of shoes 30, which do not engage or ride on bite surface 26.

Tilting, removing, and replacing sash 20 is simple and convenient, especially since sash pins 25 do not have to be laterally inserted into shoes 30 and can be latched into shoes 30 simply by lowering pins 25 from above shoes 30. Our lock shoe system is also economical in using simple components molded of resin material, a single wire spring 50, a cast metal biter knife 40, and an inexpensive screw 75. Yet, the lock shoe system reliably performs every desired function and remains durable for long service.

We claim:

1. A lock shoe system for a take-out window having a take-out jamb liner formed of resin material having a slot opening into a vertically extending lock shoe channel within which a lock shoe moves vertically of said jamb liner, said system comprising:

a. a pair of fins extending laterally outward from opposite sides of said slot within said lock shoe channel;

b. said lock shoe being arranged to bear against and ride on a sash side of said fins;

c. said lock shoe having a pivotally mounted biter knife biased to pivot into biting engagement with a frame side of said fins to lock said lock shoe vertically in place; and d. an arm of said biter knife being engaged by a pin extending from said sash into said slot for holding said knife clear of said fins whenever a free end of said sash pin engages said arm.

2. The system of claim 1 wherein said lock shoe includes a ramp lock pivotally mounted on said lock shoe so that said sash pin can move vertically over said ramp lock to pivot said ramp lock aside as said pin moves into engagement with said arm, whereupon said ramp lock snaps into lock position, holding said lock shoe on said pin during vertical movement with said pin.

3. The system of claim 2 wherein said lock shoe includes a spring that biases said ramp lock into locking position and biases said biter knife into biting position.

4. The system of claim 1 wherein said lock shoe includes a pair of friction pads engaging side surfaces of said slot, and a screw is threaded into said lock shoe for adjustably spreading said friction pads into frictional engagement with said slot surfaces.

5. A method of locking and unlocking a pair of lock shoes in take-out jamb liners for a take-out sash, said method comprising:

a. providing said lock shoes with respective biter knives biased into biting positions against said jamb liners to lock said lock shoes in place;

b. providing fins on opposite sides of sash pin slots in lock shoe channels of said take-out jamb liners, and arranging said lock shoes to ride on one side of said fins and said biter knives to bite into an opposite side of said fins; and c. holding said biter knives out of said biting positions by means of sash pins extending through said slots and into engagement with said biter knives so that said knives bite to lock said lock shoes in position only when removal of said sash from said jamb liners withdraws said sash pins from said lock shoes.

6. The method of claim 5 including providing said lock shoes with pivotally mounted ramp locks, inserting said sash pins through said slots above locked positions of said lock shoes, and moving said sash pins downward over said ramp locks into engagement with said biter knives, whereupon said ramp locks snap into lock position, holding said pins in vertical engagement with said biter knives.

7. The method of claim 6 including laterally tilting said as to withdraw said sash pins from said lock shoes, without releasing said ramp locks.

8. In a take-out window with a take-out jamb liner of resin material having a slot opening into a vertically extending lock shoe channel in which a lock shoe connected to a counterbalance spring moves vertically within said jamb liner, the improvement comprising:

a. a biter knife arranged on said lock shoe for biting into said jamb liner to lock said shoe against the force of said spring, in a vertical position within said channel;

b. a pin extending from said sash, through said slot, and into said lock shoe so that a free end of said pin holds said biter knife out of biting position as said pin moves vertically with said sash and pivots when said sash tilts;

c. said biter knife being biased to move into biting position against said jamb liner in response to withdrawal of said sash pin from said lock shoe; and d. said lock shoe riding on a ride surface of said jamb liner and said biter knife biting into a bite surface of said jamb liner separate from said ride surface.

9. The improvement of claim 8 including a ramp lock pivotally arranged on said lock shoe to allow said sash pin to move vertically in said channel, over said ramp lock, and into engagement with said biter knife, whereupon said ramp lock snaps into lock position, holding said lock shoe on said pin for vertical movement with said pin.

10. The improvement of claim 8 wherein said ride surface of said jamb liner is formed on a pair of fins extending laterally outward from opposite sides of said slot, and said bite surface of said jamb liner is on a surface of said fins opposite said ride surface.

11. A resin jamb liner for a take-out window system for a take-out sash, said jamb liner having a sash pin slot leading to a lock shoe channel in which a lock shoe moves vertically, and said jamb liner comprising;

a. a pair of opposed walls of said jamb liner on opposite sides of said pin slot extending into said lock shoe channel;

b. free end regions of said opposed walls of said pin slot extending parallel with each other within said lock shoe channel to form a pair of fins on opposite sides of said slot within said lock shoe channel; and c. ride surfaces of said fins affording smooth bearing surfaces for said lock shoe to ride on, and lock surfaces of said fins, opposite said ride surfaces, being disposed for said lock shoes to lock against and to mar without roughening said ride surfaces.

12. The jamb liner of claim 11 wherein said free end regions of said walls of said pin slot extend away from each other within said lock shoe channel.

13. The jamb liner of claim 11 wherein said ride surfaces of said fins are on sash sides of said fins and said lock surfaces of said fins are on frame sides of said fins.

14. In a take-out window system having a resin jamb liner with a slot for a take-out sash having a pin pivotally extending into a vertical lock shoe channel in which a lock shoe moves in engagement with a counterbalance spring, the improvement comprising:

a. said lock shoe having a biter knife held out of biting position by a free end of said pivotal sash pin engaging said biter knife, said sash pin being withdrawable from said lock shoe and said slot to enable said biter knife to bite against said jamb liner; and b. a ramp lock pivotally mounted on said lock shoe to allow said sash pin to move vertically in said slot to engage and ride over said ramp lock enroute to said biter knife, where said sash pin engagement with said biter knife is vertically maintained by said ramp lock.

15. The improvement of claim 14 wherein said ramp lock, when pivoted by said sash pin, engages said biter knife and moves said biter knife out of biting position.

16. The improvement of claim 14 wherein said lock shoe rides on fins extending from side walls of said slot into said lock shoe channel, and said biter knife bites against a side of said fins opposite the side on which said lock shoe rides.

17. The improvement of claim 14 including a pair of opposed friction pads engaging sides of said pin slot, and an adjustment screw for variably spreading said friction pads into variable frictional engagement with said sides of said pin slot.

18. The improvement of claim 14 wherein said ramp lock is pivotally mounted above said biter knife and said sash pin moves vertically downward over said ramp lock into said engagement with said biter knife.

19. A lock shoe connected to a counterbalance spring and arranged for riding in a lock shoe channel of an extruded resin jamb liner of a take-out window system having a take-out sash with a sash pin that pivots with said sash and extends through a vertical slot in said jamb liner into said channel, said lock shoe comprising:

a. a pair of friction pads engaging side surfaces of said slot;

b. a screw threaded into said lock shoe for adjustably spreading said friction pads into variable frictional engagement with said slot surfaces; and c. said lock shoe being arranged for locking against upward movement in said channel in response to said counterbalance spring when said lock shoe is lightened of a downward force from the weight of said sash.

20. The lock shoe of claim 19 wherein said locking arrangement for said lock shoe includes a biter knife biased for biting into a surface of said jamb liner when a free end of said pivotal sash pin is withdrawn from engagement with said lock shoe.

21. The lock shoe of claim 20 including a pviotal ramp lock arranged to allow said sash pin to move vertically in said slot to engage and ride over said ramp lock and into engagement with said biter knife, whereupon said ramp lock snaps into locking position vertically holding said lock shoe on said sash pin.

22. The lock shoe of claim 21 including a spring that biases said ramp lock into locking position and biases said biter knife into said biting position.

23. The lock shoe of claim 20 wherein said lock shoe rides on a ride surface of said jamb liner and said biter knife bites into a bite surface of said jamb liner separate from said ride surface.

24. A method of locking and unlocking a lock shoe urged upward by a counterbalance spring in a lock shoe channel in an extruded resin jamb liner for a take-out window system having a tiltable take-out sash with a sash pin that pivots with said tiltable sash and extends through a slot into said lock shoe channel, said method comprising:

a. spring biasing a biter knife on said lock shoe to bite into a surface of said jamb liner to hold said lock shoe in place against upward force of said counterbalance spring whenever said pin is withdrawn from said lock shoe;

b. engaging said biter knife with a free end of said sash pin to hold said biter knife out of biting position whenever said pin is reinserted into said lock shoe; and c. reinserting said sash pin into said lock shoe by moving said sash pin vertically over a lock ramp and into engagement with said biter knife, and latching said pin in said lock shoe with said lock ramp so that said pin cannot move vertically out of said lock shoe.

25. The method of claim 24 including biasing said lock ramp with a spring that biases said biter knife.

26. The method of claim 24 including arranging said lock shoe to ride on a pair of fins formed in said channel on opposite walls on said slot so that said biter knife bites into a surface of said fins opposite a fin surface on which said lock shoe rides.

27. A lock shoe system for use in a take-out window having an extruded resin jamb liner with a sash pin slot opening into a channel accommodating vertical movement of a lock shoe connected with a counterbalance spring, said lock shoe system comprising:

a. a pair of fins disposed within said channel so that each of said fins lies in a plane spaced between a sash side of said channel and a frame side of said channel;

b. ride surfaces of said fins supporting bearing surfaces of said lock shoe so that said lock shoe can move smoothly up and down said channel with said bearing surfaces engaging said ride surfaces and other surfaces of said lock shoe not engaging said channel; and c. lock surfaces of said fins, opposite said ride surfaces, being arranged so that said lock shoe can engage and lock against said lock surfaces and mar said lock surfaces without roughening said ride surfaces.

28. The lock shoe system of claim 27 wherein said fins extend from walls of said sash pin slot.

29. The lock shoe system of claim 27 wherein said ride surfaces of said fins are on a sash side of said fins and said lock surfaces of said fins are on a frame side of said fins.

30. A lock shoe for a take-out window having an extruded resin jamb liner with a sash pin slot and a channel for vertical movement of said lock shoe while engaging a pin of a take-out sash, said lock shoe comprising:

a. said lock shoe having a pin-receiving region wherein said sash pin engages said lock shoe during vertical movement of said sash within said jamb liner and tilting movement of said sash relative to said jamb liner; and b. a ramp lock pivotally mounted on said lock shoe and inclined toward said pin-receiving region so that when said sash pin has been laterally withdrawn from said lock shoe and is to be returned to said lock shoe, said sash pin can be moved vertically in said slot over said ramp lock to pivot said ramp lock aside as said sash pin approaches said pin-receiving region, said ramp lock snapping into a lock position as said pin enters said pin-receiving region so that said ramp lock, in said lock position, holds said pin against vertical withdrawal from said lock shoe.

31. The lock shoe of claim 30 wherein said ramp lock is arranged above said pin-receiving region so that said sash pin moves downward over said ramp lock into said pin-receiving region.

32. The lock shoe of claim 30 including a biter knife mounted in said pin-receiving region to lock said shoe vertically within said channel when said sash pin is laterally withdrawn from said lock shoe.

33. The lock shoe of claim 32 including a spring arranged on said lock shoe for biasing both said biter knife and said ramp lock.

34. The lock shoe of claim 32 wherein said ramp lock is arranged above said pin-receiving region so that said sash pin moves downward over said ramp lock into said pin-receiving region, and said ramp lock is arranged for disengaging said biter knife from a lock position as said sash pin pivots said ramp lock aside while enroute to said pin-receiving region.

35. A sash shoe connected to a counterbalance spring for movement vertically in a channel in an extruded resin jamb liner, said sash shoe receiving and moving with a pin of a take-out sash and said pin being laterally withdrawn from said shoe when said sash is removed from said jamb liner, said sash shoe comprising:

a. a spring-biased ramp pivotally mounted on said shoe adjacent a recess in said shoe for receiving said pin;

b. said ramp being mounted to pivot toward a frame side of said channel so that a previously withdrawn sash pin can move vertically along said ramp as said withdrawn pin is returned toward said pin-receiving recess in said shoe; and c. said spring-biased ramp being arranged to snap into lock position as said withdrawn pin moves over a free end of said ramp into said pinreceiving recess so that said ramp in said lock position locks said pin vertically within said recess.

36. The sash shoe of claim 35 wherein said ramp is arranged above said recess so that said withdrawn pin moves downward over said ramp and into said recess.

37. The sash shoe of claim 35 including friction surfaces arranged for adjustably engaging surfaces of said channel to vary the frictional resistance of vertical movement of said sash shoe within said channel.

38. The sash shoe of claim 35 including a lock device for holding said sash shoe against vertical movement in said channel when said pin is laterally withdrawn from said recess.

* * * * *